United States Patent [19]

Corey

[11] Patent Number: 4,527,394

[45] Date of Patent: Jul. 9, 1985

[54] HEATER HEAD FOR STIRLING ENGINE

[76] Inventor: John A. Corey, R.D. #2, Box 101 E, North Troy, N.Y. 12182

[21] Appl. No.: 571,536

[22] Filed: Jan. 17, 1984

[51] Int. Cl.[3] ..... F02G 1/04

[52] U.S. Cl. ..... 60/517; 60/526; 165/183

[58] Field of Search ..... 60/517, 520, 526; 165/183

[56] References Cited

U.S. PATENT DOCUMENTS 2,784,570 3/1957 Kohler ..... 60/526 X

FOREIGN PATENT DOCUMENTS 665989 4/1948 United Kingdom ..... 60/517

*Primary Examiner*—Allen M. Ostrager

[57] ABSTRACT

A monolithic heater head assembly which augments cast fins with ceramic inserts which narrow the flow of combustion gas and obtains high thermal effectiveness with the assembly including an improved flange design which gives greater durability and reduced conduction loss.

16 Claims, 8 Drawing Figures

FIG.1
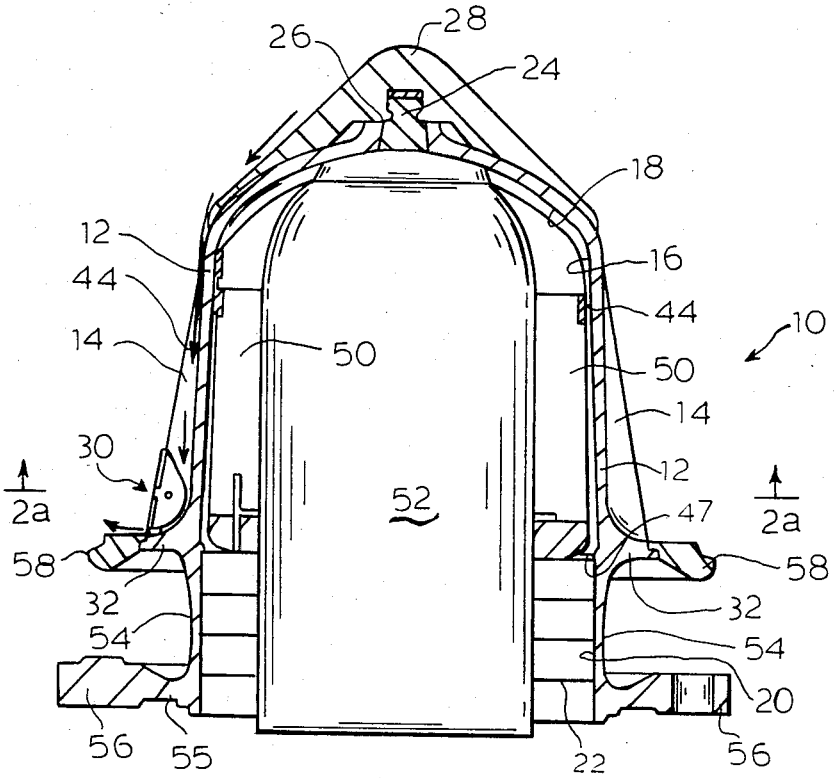
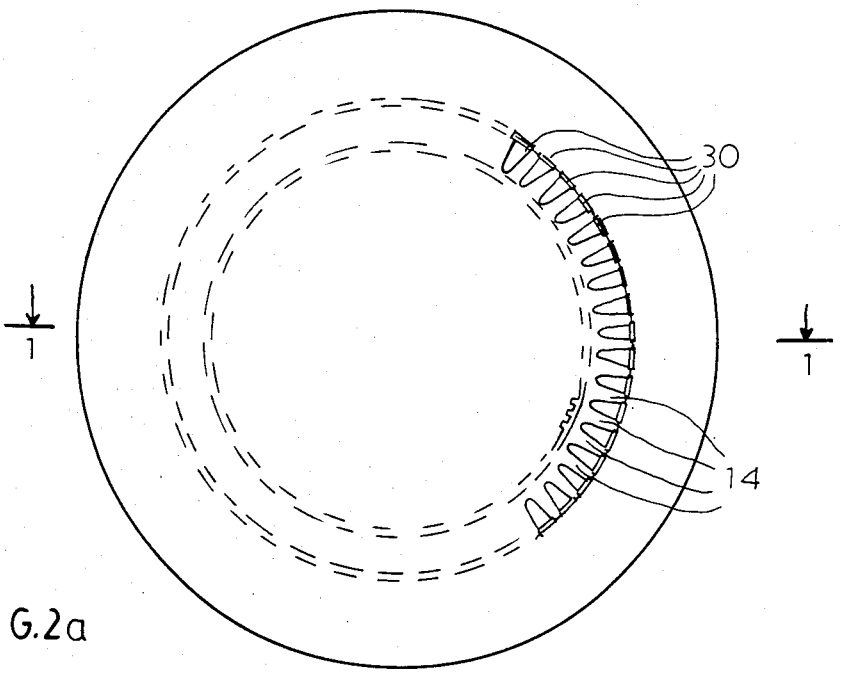
FIG.2a

FIG.2b
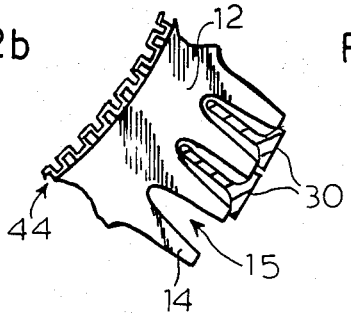
FIG.3b
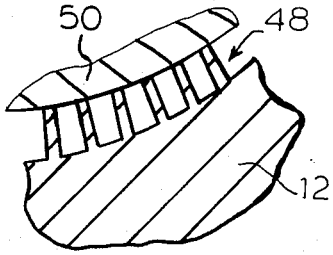
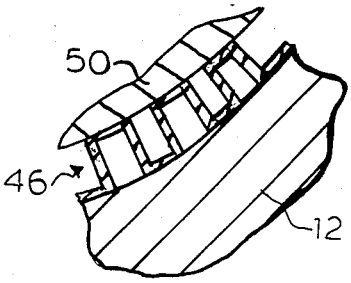
FIG. 3a
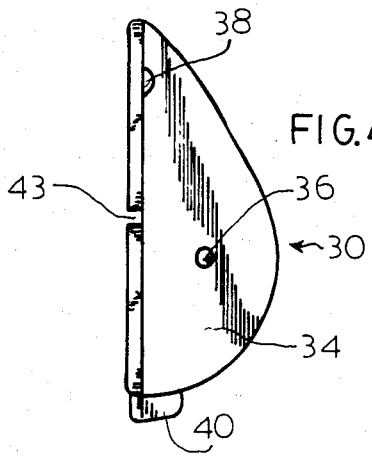
FIG.4a
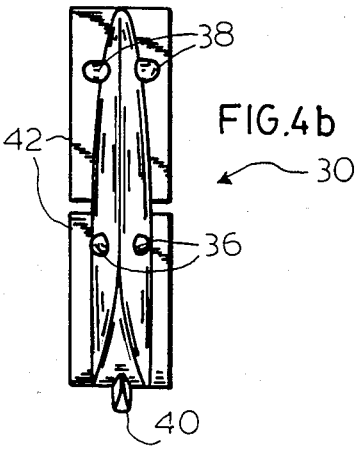
FIG.4b
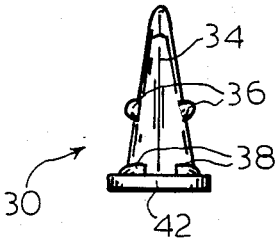
FIG.4c

HEATER HEAD FOR STIRLING ENGINE

FIELD OF THE INVENTION

The present invention relates to a heater head assembly for a Stirling engine particularly of the free piston type.

BACKGROUND OF THE INVENTION

With renewed interest in Stirling engines, there has been an ever increasing attempt to improve its efficiency and reduce the cost of fabrication to that of more conventional engines, so as to produce a competitive, cost effective product. One of the important requirements for efficient operation of a Stirling engine is an efficient utilization of the thermal energy which is generated by the combustion gas and conveyed to the working fluid. (See for example "Stirling Engines" by G. Walker, 1980 Oxford University Press, for background information). There have been many engines which are directed towards improving this. See for example U.S. patent applications, Ser. No. 423,625 for an "Internal Heater/Cylinder Head for a Stirling Engine" and Ser. No. 423,528 for an "Internal Finned Heater and Cooler for Stirling Engines", and the patents referred to therein.

While certain heater head assemblies have proven satisfactory, it has become desirable, particularly in free piston Stirling engines, to provide an improved low-cost head which is relatively easy to fabricate yet provides high performance. In this regard, a monolithic cast structure having fins cast with the pressure vessel is preferred. However, to provide adequate heat transfer, such an assembly must be fabricated with fine enough dimensions to provide efficient thermal transfer. Unfortunately, heretofore, the heater heads in this regard have either been too complex to cast effectively or lacked sufficient performance levels.

In addition, it is necessary that such a structure must be capable of withstanding high pressure and thermal loading safely without excessive thermal energy loss to adjacently positioned elements of the engine.

SUMMARY OF THE INVENTION

Accordingly, it is a principal object of the invention to provide for a heater head assembly which is thermally efficient yet readily cast as a monolithic structure avoiding the need for complex fabricating.

It is another object of the invention to provide for a heater head assembly which reduces axial conduction losses to the cooler parts of the engine while minimizing the effect of bending stresses from pressure and thermal loading on the head.

In this regard, the present invention provides for a monolithic cast heater head having integral heat exchange surfaces or fins on the external surface thereof forming channels through which a combustion gas flows. To simplify the casting and yet provide effective heat exchange, stuffers (preferably made of a ceramic material) are provided in the downstream space between adjacent fins causing the combustion gas to flow in narrower channels close to the fins. The stuffers reduce the flow area and enhance the heat transfer while permitting a relatively simple casting of the head.

On the heater heads internal surface, narrow channels and fins are provided opposite the external fins for passage of the working gas to effect heat transfer thereto.

In addition, an improved undercut flange allows both high pressure and thermal loading of the heater head while reducing axial conduction losses to the rest of the engine.

BRIEF DESCRIPTION OF THE DRAWINGS

Thus by the aforenoted invention, the aforenoted objects, advantages and others will be readily realized, the description of which should be taken in conjunction with the drawings, wherein:

FIG. 1 is a side sectional view of the heater head assembly incorporating the teachings of the present invention;

FIG. *2a* is a top sectional view taken along lines *2a—2a* of FIG. 1 showing the heater head assembly for a Stirling engine;

FIG. *2b* is an enlarged view of a portion of the vessel wall of the heater head assembly in FIG. *2a* showing the internal channels and external fins with stuffers therebetween;

FIGS. *3a* and *3b* are enlarged views of a portion of the vessel wall of the heater head assembly illustrating the internal channels; and FIGS. *4a–c* are side, plan and rear elevational views of the stuffer, incorporating the teachings of the present invention.

DETAILED DESCRIPTION OF THE PREFERRED EMBODIMENT

With more particular regard to FIG. 1, there is provided a heater head assembly 10 for a Stirling engine, particularly of the free piston type. The assembly 10 includes a thin walled, bucket-type pressure vessel 12 which is preferably cast as a single or monolithic structure having external fins 14 about its entire periphery which taper outward from the top of the vessel 12 downward. The internal surface 16 of the vessel 12 is cylindrical, tapering off at top section 18. The lower portion 20 of the internal surface 16 is also thin-walled and cylindrical and is shown with a regenerator 22 positioned therein.

The large surface area resulting from the external fins 14 and the stuffers 30, maximize the radial heat transfer in the top or hot portion of the pressure vessel. Conversely, the thin walls 54 in the regenerator area minimize axial heat transfer from the hot to the cooler portions of the engines.

The top of the pressure vessel 12 may be provided with a threaded plug 24 which may be brazed to the vessel 12 at 26 and facilitates attachment to the vessel of a ceramic or other type shield 28. This shield serves to protect the vessel 12 from flames from a combustor (not shown) generating combustion gas.

As indicated by the arrows, the combustion gas flows down the sides of the vessel in channels 15 between the exterior fins 14. The combustion gases gradually give up their heat as they flow down the side of the heater head and eventually approach the temperature of the working gas. However, the gap geometry between fins is too wide as cast to extract enough heat from the gas stream. To create a fine passage for the combustion gas close to the fins, and ultimately increase the transfer of heat to the working gas, stuffers 30 are provided in the downstream portion of the channels 15 formed between adjacent fins 14, as shown in FIG. *2b*. The vessel 12 is provided with an annular lip or flange 32 at the downstream end of the combustion gas flow path which tapers outwardly providing a curved seat for the stuffers 30. The stuffers 30, which are preferably made of a ceramic or other high temperature material, serve to reduce the flow area by dividing the channels 15 into two narrower channels close to the fin 14 surface. Thus fine tolerances in casting the fins 14 may be avoided, while still enhancing the heat transfer rate in spite of the declining temperature difference between the combustion and working gases.

As seen in FIGS. 2*b* and 4*a–c*, the stuffer 30 may be integrally constructed having a curved body portion 34 adapted to be inserted into the channel 15. Nipples 36 and 38 located thereon serve to insure that two channels are formed by spacing the body 34 away from the respective fins 14. Note that because nipples 38 are positioned adjacent the outer or wider end of the channel 15, the size of these nipples is greater. The lower end of stuffer 30 is provided with a spacer 40 which serves to lift the stuffer 30 off the flange 32 to allow the combustion gas to exit.

At the rearward portion of the body 34 there is attached spaced rectangular sections 42 which extend a distance perpendicular to the body 34. These sections 42 may be positioned abutting the outer ends of the fins 14. (See FIG. 2*b*). Note the opening 43 between sections 42 allow for a retaining strap to engage the respective stuffers to maintain them in position during assembly.

On the internal surface 16 of the vessel 12 there are provided narrow channels 44 for the working gas. These channels 44 may be formed by brazing corrugated fins 46 thereon opposite the external fins as shown in FIG. 3*a*. Alternatively, the channels 44 and internal fins 48 may be formed (by casting or machining) integrally with the vessel 12 wall as shown in FIG. 3*b*.

A liner assembly 50 may then be provided within the vessel 12 which serves to define a working cylinder 52 while shrouding and defining the inner channels 44. The outer perimeter surface of liner 50 as illustrated also serves to create separate channels. The flow of working gas into and out of the working cylinder 52 would then be restricted to channels 44 passing through the inner fins (46 or 48). The working gas during operation is effectively heated by the combustion gas to generate work in accordance with conventional Stirling engine principles. As part of this, the regenerator 22 is coupled at 47 with these channels to receive the working gas.

Due to the need for a thin wall 54 to minimize axial thermal conduction loss from the heat exchange region above, there is high thermal and pressure stressing on the vessel 12 adjacent the regenerator 22 at wall 54. The use of a thick flange 56 with an internal undercut adjacent the thin wall allows for reducing the stress on wall 54 without increasing the wall thickness and thus increasing axial conduction loss. The stiffness of flange 56 may advantageously be balanced with wall 54 to minimize peak stress thereon during operation since high pressure causes the angle between wall 54 and flange 56 to open but high temperature causes the angle between wall 54 and flange 56 to close. The undercut 55 in flange 56 allows part of the pressure and thermal stress on the thin wall 54 to be shared by the flange.

Note also that flange 32 is provided with an adaptor ring 58 which may be brazed thereon and serves to maintain or hold an external heat system for purposes of generating the combustion gas.

While the present invention advantageously avoided complex casting, some machining or bending may be required on the external surface 16, and channels formed by flanges 32, 52 and 58. However, this machining is typical for castings.

Thus by the aforenoted invention, its objects, advantages and others are realized and although preferred embodiments have been disclosed and described in detail herein, its scope should not be limited thereby, rather its scope should be determined by that of the appended claims.

What is claimed is:

1. A heater head assembly for use in a Stirling engine and the like, said assembly comprising:
   - a vessel having a vessel wall with an internal and external surface, said external surface adapted to be exposed to external heat created by a combustion gas stream, said internal surface adapted to form a Stirling engine pressure cylinder containing a working gas;
   - a plurality of external fins on said external surface forming respective channels therebetween for channeling the combustion gas therethrough; and
   - at least one removable stuffer means positioned in a channel formed between adjacent external fins dividing said channel into at least two smaller channels thereby concentrating the combustion gas to flow closely by the respective adjacent fins so as to increase thermal energy transfer from the combustion gas to working gas within the vessel.

2. The invention in accordance with claim 1 wherein said fins are integrally formed with said vessel wall.

3. The invention in accordance with claim 2 which includes a plurality of channels formed by adjacent fins with at least one respective stuffer means in each of said channels.

4. The invention in accordance with claim 1 wherein said stuffer means is made of a ceramic material.

5. The invention in accordance with claim 1 wherein said vessel includes a plurality of channels formed on the interior surface opposite the external fins for passage of working gas therethrough.

6. The invention in accordance with claim 5 wherein such channels are formed integrally with the vessel wall.

7. The invention in accordance with claim 5 wherein such channels are formed by affixing corrugated material on the interior surface.

8. A heater head assembly for use in a Stirling engine and the like, said assembly comprising:
   - vessel having a vessel wall with an internal and external surface, said external surface adapted to be exposed to an external heat source such as a combustion gas or the like, said internal surface adapted to form a Stirling engine cylinder;
   - a plurality of external fins on said external surface forming respective channels therebetween for channeling the combustive gas therethrough;
   - regenerator wall adapted to contain regenerator means and integrally formed with the vessel wall; and
   - said regenerator wall including flange means having an undercut means which results in said flange means accepting a portion of pressure and thermal stress on the regenerator wall during operating conditions.

9. The invention in accordance with claim 8 wherein said flange means includes at least two flanges integrally formed at opposite ends of said regenerator walls.

10. The invention in accordance with claim 9 which includes at least one stuffer means positioned in a channel formed between adjacent external fins dividing said channel into at least two smaller channels thereby causing the combustion gas to flow closely by the respective adjacent fins so as to increase thermal energy transfer from the combustion gas to working gas within the vessel.

11. The invention in accordance with claim 10 wherein said fins are integrally formed with said vessel wall.

12. The invention in accordance with claim 11 which includes a plurality of channels formed by adjacent fins with at least one stuffer means in each of said channels.

13. The invention in accordance with claim 10 wherein said stuffer means is made of a ceramic material.

14. The invention in accordance with claim 10 wherein said vessel includes a plurality of channels formed on the interior surface opposite the external fins for passage of working gas therethrough.

15. The invention in accordance with claim 10 wherein said channels are formed integrally with the vessel wall.

16. The invention in accordance with claim 10 wherein said channels are formed by affixing corrugated material on the interior surface.

* * * * *

UNITED STATES PATENT AND TRADEMARK OFFICE

CERTIFICATE OF CORRECTION

PATENT NO. : 4,527,394

DATED : July 9, 1985

INVENTOR(S) : John A. Corey

It is certified that error appears in the above-identified patent and that said Letters Patent are hereby corrected as shown below:

Column 1, before "Field of the Invention" insert the following new paragraph --The Government of the United States of America has rights in this invention pursuant to a Subcontract under Contract No. 86X-61618C awarded by the United States Department of Energy.--;

Column 1, line 22, change "423,625" to --423,526--;

Column 1, line 24, insert after "423,528" --now U.S. Patent No. 4,483,143--.

Signed and Sealed this

*Fifteenth* Day of *October 1985*

[SEAL]

*Attest:*

*Attesting Officer*

DONALD J. QUIGG

*Commissioner of Patents and Trademarks—Designate*